US009837710B2

(12) United States Patent
Werner et al.

(10) Patent No.: US 9,837,710 B2
(45) Date of Patent: Dec. 5, 2017

(54) BROADBAND MONOPOLE ANTENNA USING ANISOTROPIC METAMATERIAL COATING

(71) Applicant: The Penn State Research Foundation, University Park, PA (US)

(72) Inventors: Douglas H. Werner, State College, PA (US); Zhihao Jiang, State College, PA (US); Micah D. Gregory, Trout Run, PA (US)

(73) Assignee: The Penn State Research Foundation, University Park, PA (US)

( * ) Notice: Subject to any disclaimer, the term of this patent is extended or adjusted under 35 U.S.C. 154(b) by 624 days.

(21) Appl. No.: 14/054,197

(22) Filed: Oct. 15, 2013

(65) Prior Publication Data

US 2014/0104136 A1 Apr. 17, 2014

Related U.S. Application Data

(60) Provisional application No. 61/713,983, filed on Oct. 15, 2012.

(51) Int. Cl.

| | |
|---|---|
| ***H01Q 9/30*** | (2006.01) |
| ***H01Q 1/36*** | (2006.01) |
| ***H01Q 9/32*** | (2006.01) |
| ***H01Q 15/00*** | (2006.01) |

(52) U.S. Cl.

CPC ..... *H01Q 1/364* (2013.01); *H01Q 9/32* (2013.01); *H01Q 15/0086* (2013.01); *Y10T 29/49016* (2015.01)

(58) Field of Classification Search

CPC ..... H01Q 1/364; H01Q 15/0086; Y10T 29/49016

See application file for complete search history.

(56) References Cited

U.S. PATENT DOCUMENTS 5,563,616 A * 10/1996 Dempsey ..... H01Q 1/38 343/700 MS
6,249,256 B1 * 6/2001 Luxon ..... H01Q 1/084 343/702
8,271,241 B2 * 9/2012 Akyurtlu ..... H01P 1/20 29/602.1

(Continued)

FOREIGN PATENT DOCUMENTS

CN 103367907 * 4/2012 ..... H01Q 1/42
WO 2013027029 A1 2/2013

OTHER PUBLICATIONS

King H., et al., "An Experimental Study of a Balun-fed Open-sleeve Dipole in Front of a Metallic Reflector," IEEE Translation on Antennas and Propagation, 20:201-204, 1972.

(Continued)

*Primary Examiner* — Trinh Dinh
(74) *Attorney, Agent, or Firm* — Dinsmore & Shohl LLP

(57) ABSTRACT

An antenna system is provided that includes an antenna having an elongated conducting segment, such as a metal rod. An anisotropic metamaterial surrounds the elongated conducting segment of the antenna. The presence of the metamaterial remarkably expands the VSWR <2. An example antenna is a monopole antenna, such as a quarter-wavelength monopole antenna, surrounded by the metamaterial.

21 Claims, 10 Drawing Sheets

(56) References Cited

U.S. PATENT DOCUMENTS

| | | | | |
|---|---|---|---|---|
| 8,847,840 | B1 * | 9/2014 | Diaz | H01Q 1/364 343/793 |
| 8,912,973 | B2 * | 12/2014 | Werner | H01Q 15/0053 343/810 |
| 2009/0140946 | A1 | 6/2009 | Ziolkowski et al. | |
| 2012/0105970 | A1 * | 5/2012 | Ueda | G02B 1/002 359/642 |
| 2012/0280872 | A1 * | 11/2012 | Werner | H01Q 15/0053 343/753 |
| 2014/0085693 | A1 * | 3/2014 | Mosallaei | G02B 1/002 359/107 |
| 2014/0313080 | A1 * | 10/2014 | Smith | H01Q 3/00 342/372 |

OTHER PUBLICATIONS

Roger S.D., et al., "Design and Realization of GA-optimized Wire Monopole and Matching Network with 20:1 Bandwidth," IEEE Transaction on Antennas and Propagation, 51(3):493-502, 2003.

Jiang Z., et al., "A Broadband Monopole Antenna Enabled by an Ultrathin Anisotropic Metamaterial Coating," IEEE Antennas and Wireless Propagation Letters, 10:1543-1546, 2011.

Ziolkowski R.W., et al., "Metamaterial-based Efficient Electrically Small Antennas," Antennas and Propagation, IEEE Transactions, 54(7):2113-2130, 2006.

* cited by examiner

BROADBAND MONOPOLE ANTENNA USING ANISOTROPIC METAMATERIAL COATING

CROSS REFERENCE TO RELATED APPLICATIONS

This invention depends from and claims priority to U.S. Provisional Application No. 61/713,983 filed Oct. 15, 2012, the entire contents of which are incorporated herein by reference.

FIELD OF THE INVENTION

The invention relates to antennas, in particular antennas with a broadband response.

BACKGROUND OF THE INVENTION

Development of lightweight, small, and electrically efficient antennas and antenna systems continues to increase with an ever greater need to transmit large amounts of data. Research into ultra-wide band systems is hoped to further address this need. Small size and lightweight construction are paramount in the development of future systems so that the antenna can be contained in a wearable, easily transportable, or lightweight system. Typically small size is defined as having a dimension of $\lambda/10$ or less. In addition, future antenna systems should cover a frequency range from 20 MHz to 6 GHz or broad ranges therein so as to be applicable to many systems ranging from the traditional HF and UHF bands as well as for use in the ever more heavily used wireless computer network and cellular bands of 3-5 GHz.

Many prior systems attempting to have wide band applicability employed combinations of antenna shapes. However, these suffer from the need for significant feed networks that add to the cost, complexity and weight of the system. Other attempts used combinations of monopoles of varying height, but these require a stepped sequence for both transmitting and receiving data.

In the very- and ultra-high frequency (VHF/UHF) and microwave frequency range, previous efforts to broaden the impedance bandwidth of a conventional quarter-wavelength wire monopole primarily involved sleeve monopoles or loading the wire with lumped elements. The sleeve monopole uses multiple additional wire radiators of shorter length surrounding the central main radiator to create an additional resonance, resulting in a broadened impedance bandwidth. Of concern, however, is the larger physical footprint of the antenna system, which is especially troubling at low frequencies. The weight of the antenna system also increases due to the added thick copper wires. The other technique employs strategically placed serial lumped LR (inductive and resistive) circuits along the monopole to introduce multiple resonances and thus a broader impedance bandwidth. Several physical and performance related drawbacks arise with this technique as well. Mainly, the length of the monopole is greatly elongated, the weight is increased due to the added loading and matching network, and the gain is reduced due to the losses of the circuit elements. Moreover, the cost is increased due to the addition of the RL circuit elements.

As such, there is a need for a wide-bandwidth antenna that does not significantly increase antenna complexity, footprint, or weight.

SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

Examples of the invention include improved antennas in which an anisotropic metamaterial is used to increase the impedance bandwidth. For example, a compact flexible anisotropic metamaterial (MM) coating greatly enhances the impedance bandwidth of a quarter-wave monopole, in some cases to over an octave.

An example MM coating has a high effective permittivity for the tensor component oriented along the direction of a monopole. The MM may be flexible and optionally formed into a cylindrical arrangement around a conducting element. Through selection of the radius and tensor parameter of the MM coating another resonance at a higher frequency can be efficiently excited without affecting the fundamental mode of the monopole. Additionally, similar current distributions on the monopole at both resonances allow stable radiation patterns over the entire band.

As such, an antenna system is provided that includes an antenna, the antenna including an elongated conducting segment, and a tubular element of anisotropic metamaterial, the anisotropic metamaterial element coating the elongated conducting segment. Optionally, the elongated conducting segment is elongated along an axial direction and the anisotropic metamaterial includes a plurality of unit cells, each unit cell including a conducting pattern being elongated along a direction parallel to the axial direction. In some embodiments, the anisotropic metamaterial has a generally cylindrical form having a length, the elongated conducting segment being located within the cylindrical form, and the length equal to or greater than the axial length of the elongated conducting segment. A metamaterial optionally has a dielectric anisotropy. Optionally, the anisotropic metamaterial has a maximum permittivity in a direction parallel to the axial direction. The antenna system optionally is formed where the elongated conducting segment is a rod-like conductor. The antenna is optionally a monopole antenna. In some embodiments of the antenna system, the antenna is a monopole antenna and the anisotropic metamaterial element is at least partially surrounding the conducting segment where the anisotropic metamaterial includes a plurality of elongated conducting elements having a length oriented parallel to an axial direction of the conducting segment.

Also provided are methods of increasing the bandwidth of an antenna, the antenna having an elongated conducting segment having an elongation direction, the method including disposing an anisotropic metamaterial around the elongated conducting segment, the anisotropic metamaterial having a maximum permittivity in a direction parallel to the elongation direction. Optionally, the anisotropic metamaterial has a cylindrical tube-like form, the cylindrical tube like form having a tube length and an tube inner radius, the antenna has an operating wavelength, the elongated conducting segment has an antenna length and an antenna radius, where the tube length is greater than the elongated conducting segment length, the tube inner radius is greater than the elongated conducting segment radius, and the tube inner radius is less than an operating wavelength.

Also provided are anisotropic metamaterials having a cylindrical tube-like form and an elongation direction where the maximum electrical permittivity is greatest along the elongation direction, and the anisotropic metamaterial is configured to fit over an antenna. Configured to fit over an antenna is to surround an antenna in at least a radial direction and optionally extend beyond the length of the antenna. The anisotropic metamaterial is optionally incorporated into a radio transceiver including an antenna, the antenna being at least partially enclosed within the anisotropic metamaterial. The anisotropic metamaterial optionally includes a dielectric substrate and a plurality of conducting elements coated on the substrate. The conducting elements are optionally in the shape of an I. The conducting elements optionally have a length greater than a width, the length parallel to an axial direction of the cylindrical tube-like form. The anisotropic metamaterial optionally surrounds a conducting element in a radial direction from the conducting element. The anisotropic metamaterial optionally has an impedance bandwidth of an octave or greater. The anisotropic metamaterial optionally has a plurality of capacitive gaps between the conducting elements. Optionally, the anisotropic metamaterial has two or more resonances. Optionally, anisotropic metamaterial has a VSWR <2 bandwidth of 1 GHz or greater, optionally 2 GHz or greater.

BRIEF DESCRIPTION OF THE FIGURES

FIG. 1(*b*) illustrates the monopole of FIG. 1(*a*) with and ultra-thin flexible anisotropic MM coating according to one embodiment of the invention;

FIG. 1(*c*) illustrates an anisotropic MM coating manufactured to surround a monopole antenna according to one embodiment of the invention;

FIG. 1(*d*) illustrates an anisotropic MM coating surrounding a monopole antenna element and contacting a ground plane according to one embodiment of the invention;

FIG. 7(*b*) illustrates simulated and measured H-plane (x-y plane) and E-plane (y-z plane) radiation patterns of an S-band MM coated monopole at 3.3 GHz with the solid lines representing the H-plane patterns and the dashed lines representing the E-plane patterns;

FIG. 7(*c*) illustrates simulated and measured H-plane (x-y plane) and E-plane (y-z plane) radiation patterns of an S-band MM coated monopole at 4.4 GHz with the solid lines representing the H-plane patterns and the dashed lines representing the E-plane patterns;

FIG. 8(*b*) illustrates simulated VSWR of the sleeve monopole of FIG. 8(*a*) relative to a monopole with an actual metamaterial coating and to a monopole with homogeneous anisotropic effective medium coating.

DETAILED DESCRIPTION EMBODIMENTS OF THE INVENTION

The following description of particular embodiment(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the processes or apparatuses are described as an order of individual steps or using specific materials, it is appreciated that steps or materials may be interchangeable such that the description of the invention may include multiple parts or steps arranged in many ways as is readily appreciated by one of skill in the art.

Provided are systems that greatly enhance the impedance bandwidth of a monopole antenna by surrounding it with an anisotropic metamaterial (MM) coating. The term MM coating includes anisotropic MM elements, such as those described herein. A metamaterial is an assembly of individual element unit cells assembled in a periodic or irregular pattern. The invention has utility as an antenna for transmitting or receiving information over a broad frequency range. The anisotropic MM coating gives rise to multiple resonances including at least one higher frequency resonance relative to an uncoated monopole antenna, which enables a similar current distribution on the monopole to that of the fundamental mode through the MM's broadband anisotropic property. In contrast to previously reported broadband planar monopoles that typically develop multiple lobes in their radiation patterns as frequency increases, the inventive high bandwidth metamaterial-enabled monopole has stable vertically polarized radiation patterns over the entire frequency band of operation. Moreover, compared to broadband open-sleeve dipoles/monopoles and broadband dielectric resonator antennas fed by monopoles, the provided MM-coated monopole antennas are more compact and extremely lightweight such that they may easily be employed in many possible applications ranging from broadband arrays to portable wireless devices.

As such, provided is an antenna system that includes an antenna with an elongated conducting segment and a tubular element of anisotropic metamaterial, the anisotropic metamaterial element coating the elongated conducting segment.

The term "coating" is used to indicate that the metamaterial generally surrounds the conducting segment where "surrounds" is at least around the radial outer dimension, and does not require that the MM is formed directly on the antenna surface or is directly adhered to it. In example configurations, the coating configuration gives rise to a second higher frequency resonance that enables a similar current distribution on the monopole to that of the fundamental mode through the MMs broadband anisotropic property.

Figures 1A, 1B:
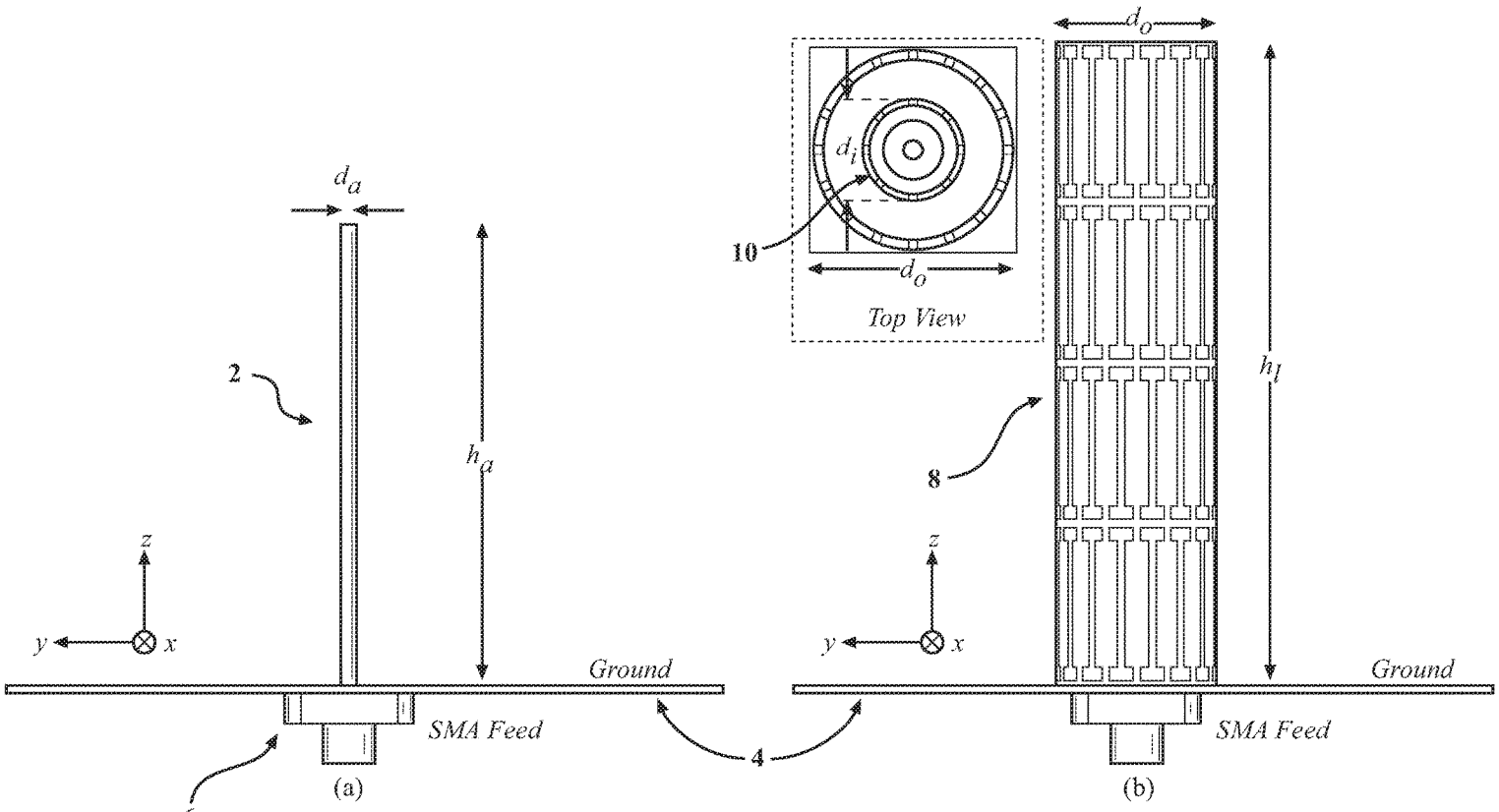
FIG. 1(a) Prior Art
FIG. 1(*a*) illustrates a configuration of a quarter-wave monopole antenna as known in the art.
Figure 1C:
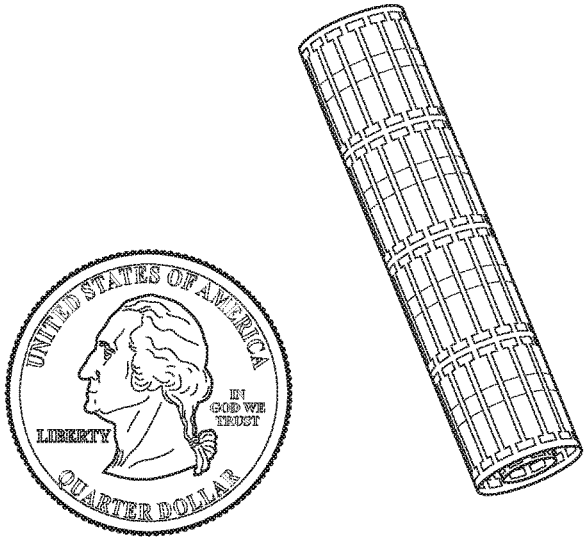
Figure 1D:
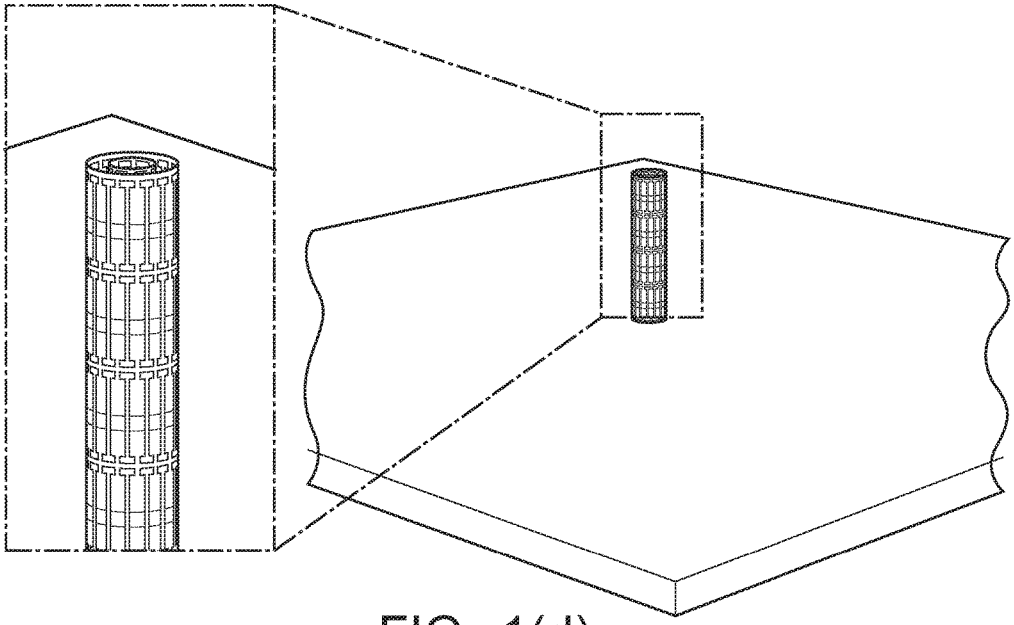

The conducting segment is optionally a monopole antenna, but in some examples, a MM coating may be provided for conducting segments of a more complex design. In some examples, the coating may surround a coiled or partially coiled antenna configuration. In some examples, an antenna array, such as a phased array, may include antenna elements with an MM coating. An exemplary monopole antenna as known in the art is depicted in FIG. 1(*a*) illustrating an antenna 2 extending from a ground plane 4. The antenna 2 is electrically connected to an SMA feed 6 that is used to carry signals from the antenna to an associated device. An antenna is depicted in FIG. 1 as a cylindrical or substantially linear shape for illustrative purposes alone. An antenna 2 has a height ($h_a$) and a diameter ($d_a$).

An illustrative example of an inventive MM element 8 is depicted in FIG. 1(*b*) illustrating a two layered system surrounding the monopole antenna of FIG. 1(*a*) vertically in the shape of a tube. A MM element is optionally electrically associated with the ground plane 4. An MM element has a length ($h_l$) and an outer diameter ($d_o$). The inset depicts a second MM element contained within a first MM element where the second MM element 10 has a similar elongated tubular shape and is circumferentially contained entirely within the first MM element. The second MM element includes a diameter ($d_i$) and a height that is equal to, smaller than, or greater than $h_l$.

If the conducting segment has an elongated rod-like form, the MM may have an elongated cylindrical form surrounding the antenna and optionally be generally coaxial, concentric, or both. The cross-section of an MM layer is optionally circular (as in the case of a cylindrical tube), square, rectangular (e.g. a box shaped tube), or other form. The radial gaps between the antenna and the MM layers 8, 10 may be selected, for example, to provide an integer number of unit cells around the circumference of the MM. In some embodiments, the number of unit cells are arranged to maintain radiation pattern symmetry in the H-plane. Optionally, the number of unit cells should be a multiple of four. Optionally the number of unit cells is 4, 8, 12, 16, 20, 24, 28 or a greater multiple of four.

The MM element may include one or more curved or otherwise formed MM layers surrounding the antenna, and optional spacers configured to hold the MM layer(s) and antenna in appropriate relative locations. The spacers may be non-electrically-conducting, such as a dielectric material, such as a polymer.

A metamaterial element may include a plurality of conducting patterns formed on a dielectric substrate, such as a dielectric sheet. Illustrative examples of a dielectric sheet material include a liquid crystal polymer (LCP), polydimethylsiloxane (PDMS), or other dielectric material known in the art. The conducting patterns are formed of a conducting material such as a metal film (e.g. copper) or other conductive material formed on the dielectric substrate. In some cases, etching techniques using an etchant such as cupric chloride may be used to form the conducting patterns. Patterns may be formed on one or both sides of the substrate.

The dielectric substrate is optionally flexible so that it may be used to conform around a conducting segment or portion thereof. The anisotropic metamaterial may include one or more substrates, for example two or more substrates arranged in concentric cylinders around the conducting segment.

An MM layer may include an array of unit cells with each unit cell including a conducting pattern. In some examples, the unit cells and/or conducting patterns are elongated in the elongation direction of the conducting segment. For example, the unit cell is optionally rectangular. A rectangular shape optionally has a long side being at least 25% greater than the short side. In a tube-like configuration a rectangular unit cell may be curved in space around the conducting segment.

Figure 2:
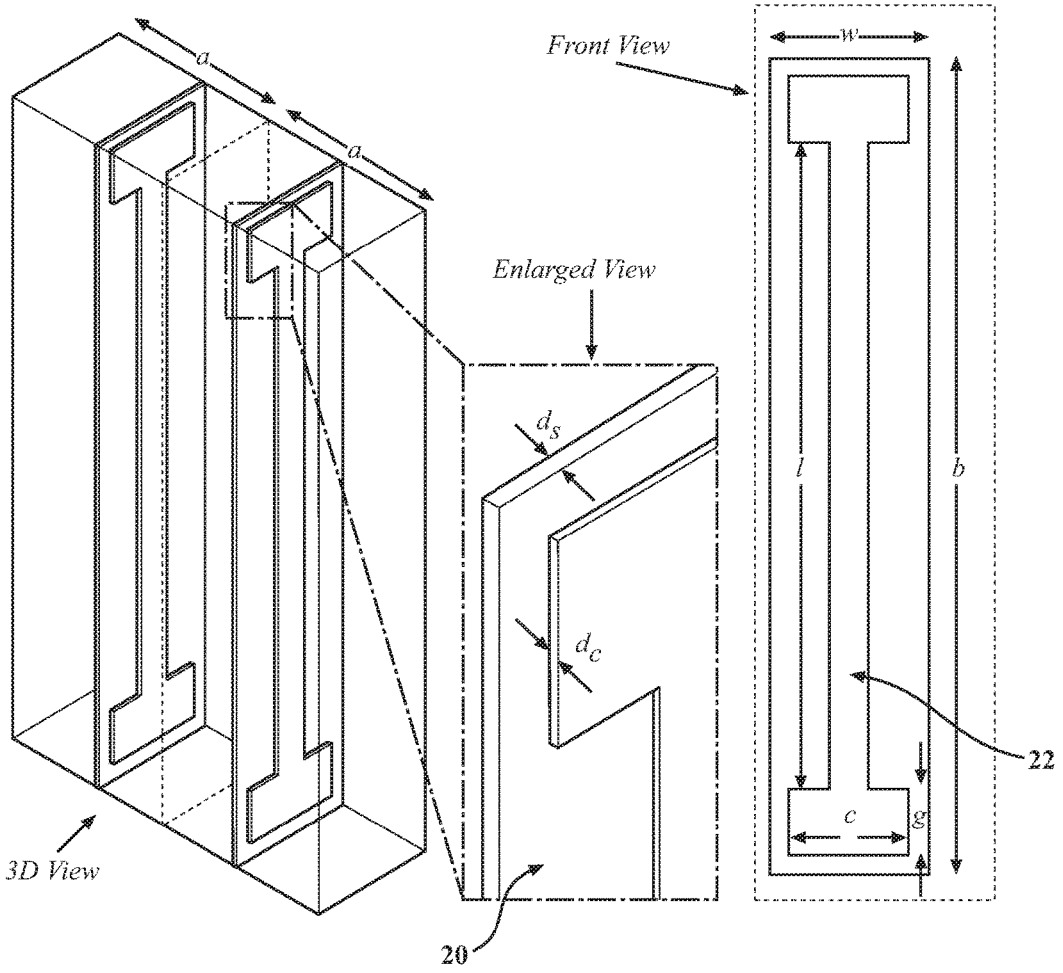
FIG. 2 illustrates geometry and dimensions of unit cells of an anisotropic MM coating according to one embodiment of the invention.

An exemplary embodiment of a MM unit cell is illustrated in FIG. 2 depicting a substrate 20 having a thickness ($d_s$) and a length (in unit cell; b). A thickness $d_s$ is optionally from 10 μm to 2 mm or any value or range therebetween. In some embodiments, the thickness $d_s$ is optionally greater than 2 mm such as in the case of dielectric materials with lower flexibility. The unit cell also includes the substrate width (w) that is optionally of 10 μm to 70 μm, or any value or range therebetween. Optionally, a width is less than 10 μm. Optionally a width is greater than 70 μm. The substrate has coated on it or contained within it a conducting material having a shape to form a conducting pattern. The conducting material itself has a thickness ($d_c$). The conducting pattern 22 is depicted having an I shape for illustrative purposes alone. Other exemplary shapes include a meander, circular, oval, quadrilateral, or other suitable elongated shape. The I shape pattern has a length (l) extending between two ends. The ends have a width (c) and a height (g). The c and g dimensions of the ends may be identical between the two ends or different. Also depicted is a grouping of tubular layers illustrating a layered unit cell of an inner coated substrate and an outer coated substrate with the thickness of the unit cell defined by dimension (a) as a distance between layers of coated substrate material. The presence of the conducting material of a shape produces an anisotropy to the MM system. Antenna systems according to examples of the present invention use the synthetic anisotropy of an ultrathin metamaterial surface coating to broaden impedance bandwidth of a standard quarter-wave monopole, for example, to over an octave.

The unit cell may include one or more capacitive gaps. A capacitive gap may be formed between conducting patterns in adjacent unit cells, optionally only between unit cells adjacent in the elongation direction. The effective permeability of the MM may be close enough to unity so as not to disturb the magnetic field pattern. The effective permittivity may be close to unity for axial directions, directed away from the antenna, and appreciably greater for the elongation (axial) direction along the antenna. For example, the effective axial permittivity may be greater than 3, for example greater than 5, and in some cases greater than 8, while the effective radial permittivity may be positive but less than 2, in some cases less than 1.5.

A metamaterial element may be in the form of an ultrathin element. An ultrathin element optionally has a thickness in the range 0.1 mm-10 mm, but may be greater or less than this range. An ultrathin metamaterial element is optionally formed into a tubular configuration having an outer radius ($d_o$, $d_i$, or both) much less than the operational wavelength, for example equal to or less than $\lambda/5$, in some cases equal to or less than $\lambda/10$.

Compared to sleeve monopoles, this MM element approach provides a broader impedance bandwidth with a smaller footprint. The advantages are more significant at low frequencies where the ultrathin metamaterial surface remains light weight and compact, even at VHF and UHF. Compared to the loaded monopole the metamaterial-monopole approach described herein maintains a shorter quarter-wavelength height and the antenna gain is not impacted by the metamaterial structure. The metamaterial-monopole approach overcomes the main drawbacks associated with the conventional wideband techniques, which become extremely critical in low frequency applications.

Optionally, more than one layer of MM may be used. For example, a conducting element is optionally coated with 2, 3, 4, or more MM layers. The MM layers are optionally spaced apart by a distance. Thin cylindrical dielectric spacers can be used in between the monopole and the MM, and optionally between MMs, to provide a more stable and robust structure than polypropylene spacers used in example microwave devices. Multiple MM layers are optionally concentric, or otherwise having the same central point in cross section.

Examples of the present invention greatly enhance the impedance bandwidth of an antenna, such as a quarter-wave wire-type monopole antenna, by surrounding it with an anisotropic MM coating. The MM coating may be thin (e.g. compared to the antenna dimensions) and flexible, allowing the MM substrate to surround the antenna along its length.

Specific examples of the invention include a radio transceiver, including radio bands in the VHF, UHF, and/or FM bands, configured to provide two-way wireless communication. Examples include electrically short monopole antennas. Examples also include transmitters and receivers, as an individual apparatus or combined in a transceiver. Examples include a radio apparatus having a monopole antenna, quarter-wavelength whip antennas and/or electrically short antennas. The antenna may be in the form of a metal rod. The antenna and metamaterial coating may both be flexible. A metamaterial coating may be included in or covered by a protective jacket. More specific exemplary apparatuses include radios, portable transceivers such as walkie-talkies, radio scanners, radio or radar transmitters, GPS receivers, and other communication or other electronic devices.

One specific example of the invention is an improved manpack radio, such as a portable VHF-UHF multi-band radio transceiver. The radio may include a dedicated power supply, a transceiver electronic circuit, and a monopole antenna. An anisotropic MM is disposed around the antenna. The size reduction advantages over previous approaches become more significant at lower frequencies, as the anisotropic metamaterial thickness and metamaterial layer radius may both be much less than the operating wavelength.

Various aspects of the present invention are illustrated by the following non-limiting examples. The examples are for illustrative purposes and are not a limitation on any practice of the present invention. It will be understood that variations and modifications can be made without departing from the spirit and scope of the invention.

EXAMPLES

An S-band MM coated monopole substantially as depicted in FIG. 1(*c*) was designed, fabricated and characterized. The MM coating was realized by first fabricating two planar MM sheets for the inner and outer layers. The two sheets were then curled to form the inner and outer layers of the metamaterial coating as shown in FIGS. 1(*c*) and 1(*d*). Four polypropylene washers were used as a frame for the coating and to define the inner and outer layer diameters. The inner substrate layer is held in place by friction and the outer layer is held in place with thin strips of polyimide tape around the outside of the coating. The structural rings and thin strips of tape were positioned at the centers of the I-shaped metallic structures to avoid influencing the capacitances in the gaps.

The monopole is 28.5 mm long and resonates at 2.5 GHz. The cylindrical MM coating has two concentric layers of MM cells, as illustrated in FIG. 1(*b*). The inner and outer layers include eight and sixteen unit cells along their circumference, respectively, in order to approximate a circular outer periphery to minimize its impact on the monopole's omnidirectional radiation patterns in the H-plane. The outer radius of the MM is 5 mm or about $\lambda/24$ at 2.5 GHz, ensuring that the ultra-thin sub-wavelength coating is compact in the radial direction.

The unit cell of the MM coating includes two identical I-shaped copper patterns printed on both sides of a Rogers Ultralam 3850 substrate. The thicknesses of the substrate ($d_s$) and the copper ($d_c$) are 51 μm and 17 μm, respectively. Using this thin flexible substrate, the nominally planar MM structure can be formed into a cylindrical configuration. The effective medium properties of the MM are obtained where periodic boundary conditions are assigned to the walls in the y- and z-directions. A TE/TM polarized plane wave, with the E-field/H-field oriented along the z-direction, is incident from the left half-space at an angle of $\phi$ ($0° \leq \phi \leq 90°$) with respect to the x-axis. An anisotropic inversion technique was employed to extract all six effective permittivity and permeability tensor quantities from the S-parameters calculated at different angles of incidence using Ansoft high frequency structure simulator (HFSS) finite element solver.

Figure 3:
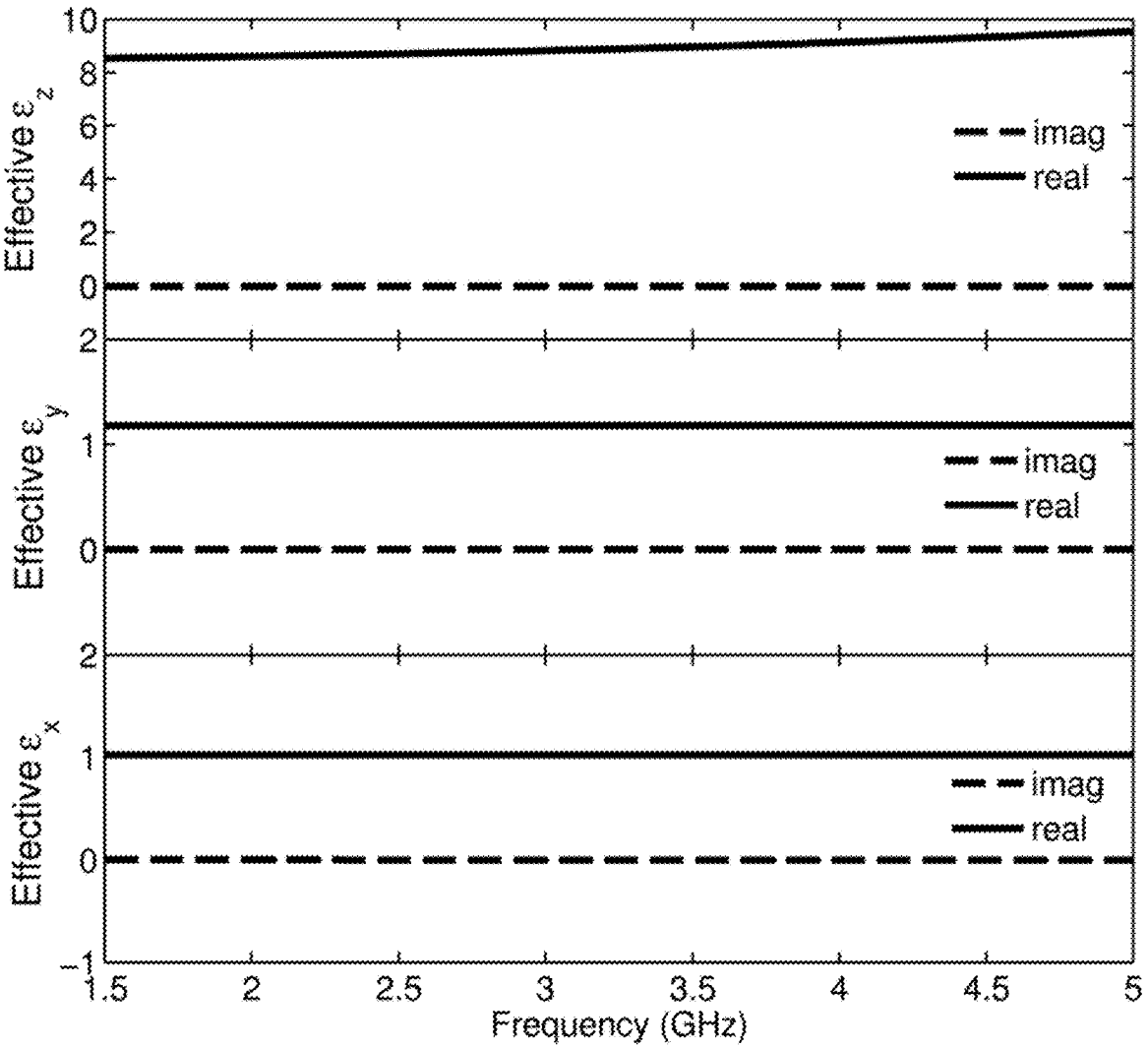
FIG. 3 illustrates real and imaginary parts of retrieved effective anisotropic permittivity tensor parameters ($\in_x$, $\in_y$, $\in_z$) of an antenna constructed according to FIG. 1(*c*)

The retrieved effective permittivity tensor parameters are shown in FIG. 3(*b*). It can be seen that none of the parameters exhibit a resonant response in the band of interest as a result of the sub-wavelength sized I-shaped elements. The retrieved $\in_x$ and $\in_y$ have non-dispersive values near unity, whereas $\in_z$ exhibits a large value which is attributed to the inductance provided by the central microstrip in the I-shaped elements and capacitance associated with the gaps between the stubs of adjacent unit cells in the z-direction. Controlling the series inductance and capacitance enables manipulation of the value of $\in_z$ across the band. The three effective permeability tensor parameters (not shown here) have non-dispersive values equal to unity with very low loss, indicating that the MM does not have any effect on the radiated magnetic field.

Figure 4:
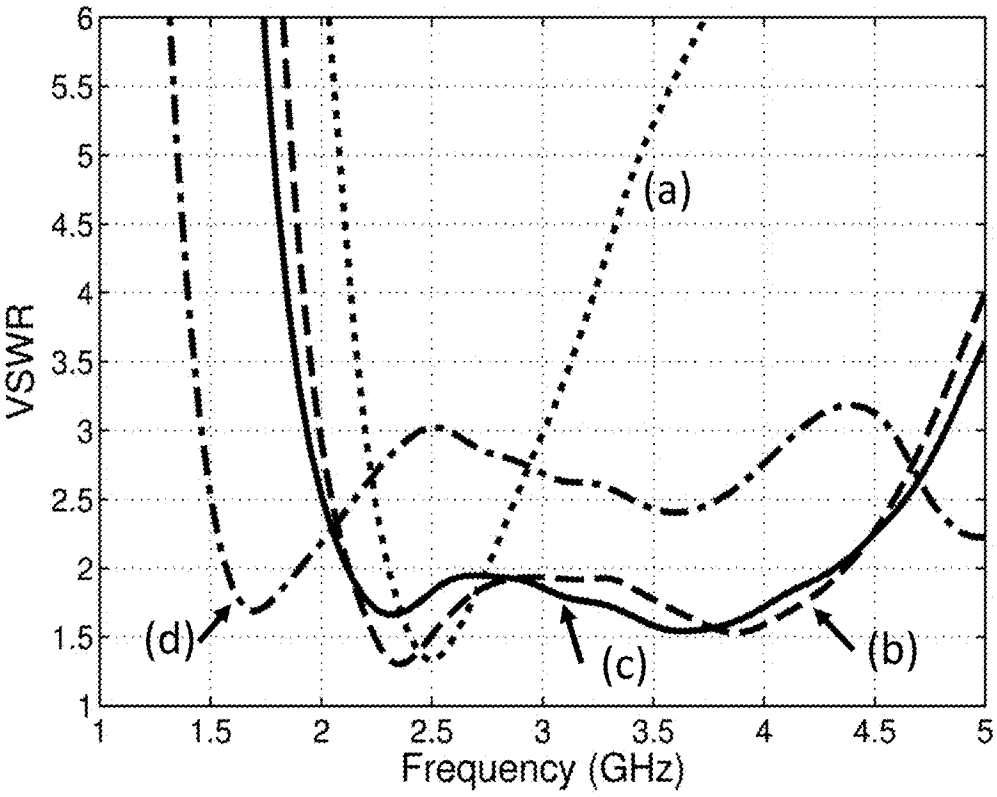
FIG. 4 illustrates simulated VSWR of an S-band monopole antenna alone (a), an S-band monopole with and actual MM coating constructed according to FIG. 1(*c*) (b), an S-band monopole with homogeneous anisotropic effective medium coating (c), and an S-band monopole with homogeneous isotropic effective medium coating (d) with the same ground plane size (32 cm×32 cm) used in all four simulations.

When applying this MM to the monopole antenna only a finite number of unit cells can be utilized; and instead of a planar structure used in the S-parameter simulations, a curved configuration is adopted to achieve a uniform coating surrounding the monopole. The radius and the effective $\in_z$ were carefully chosen during the design process in order to generate the optimal antenna performance. To examine the effect of the MM coating on the impedance bandwidth of the monopole and the efficacy of the anisotropic effective medium model, we compared the simulated VSWR for four cases: the monopole alone, the monopole with the actual MM coating, and the monopole with both anisotropic and isotropic effective medium coatings (FIG. 4). The system exhibited a 2.14:1 bandwidth (2.15-4.6 GHz) with a VSWR of less than 2:1. The demonstrated MM coating has a radius of only $\lambda/24$ and negligible weight, which renders it attractive for use in applications such as broadband arrays and portable wireless devices.

As illustrated in FIG. 4, the monopole alone (a) yields a VSWR <2 bandwidth of 0.4 GHz (2.3~2.7 GHz) with a single resonance at 2.5 GHz, whereas with the actual MM coating present, the VSWR <2 bandwidth is remarkably broadened to 2.3 GHz (2.1~4.4 GHz) (b). The main resonance shifts down slightly to 2.35 GHz and a new resonance is enabled at 3.85 GHz. When a homogeneous anisotropic effective medium coating with the retrieved material parameters is used, the VSWR exhibits a similar behavior to that of the actual MM coating (c). The VSWR <2 bandwidth is 2.2 GHz (2.1~4.3 GHz) with the first and the second resonance located at 2.32 and 3.65 GHz, respectively, indicating that the assumed homogeneous anisotropic effective medium model is a valid approximation for the actual curved MM. This is primarily because a sufficient number of unit cells are used to form the cylindrical coating such that the MM still possesses a reasonably good local flatness. In addition, considering that the effective medium parameters extracted from the S-parameters calculated at different angles of incidence remain essentially unchanged (not shown here), the effective $\in_\rho$ and $\in_\phi$ components of the cylindrical MM coating can therefore be represented by the retrieved effective $\in_x$ and $\in_y$. For additional comparison, a simulation of the monopole when loaded with a homogeneous isotropic coating (which can be considered as a dielectric ring resonator) with permittivity equal to the value of the retrieved $\in_z$ of the MM is also given (d). It can be seen that the isotropic coating shifts the main resonance to a much lower frequency due to loading with a high isotropic permittivity. It has two additional resonances, one at 3.6 GHz and another near 5 GHz; however, they do not serve to reduce the antenna's VSWR below 2. Further studies (not included here) reveal that when the radius of the isotropic coating is increased to about $\lambda/4$ and the gap between the dielectric ring and the monopole is carefully tuned, the bandwidth can be increased to over an octave. However, the structure becomes bulkier and heavier.

Figure 5:
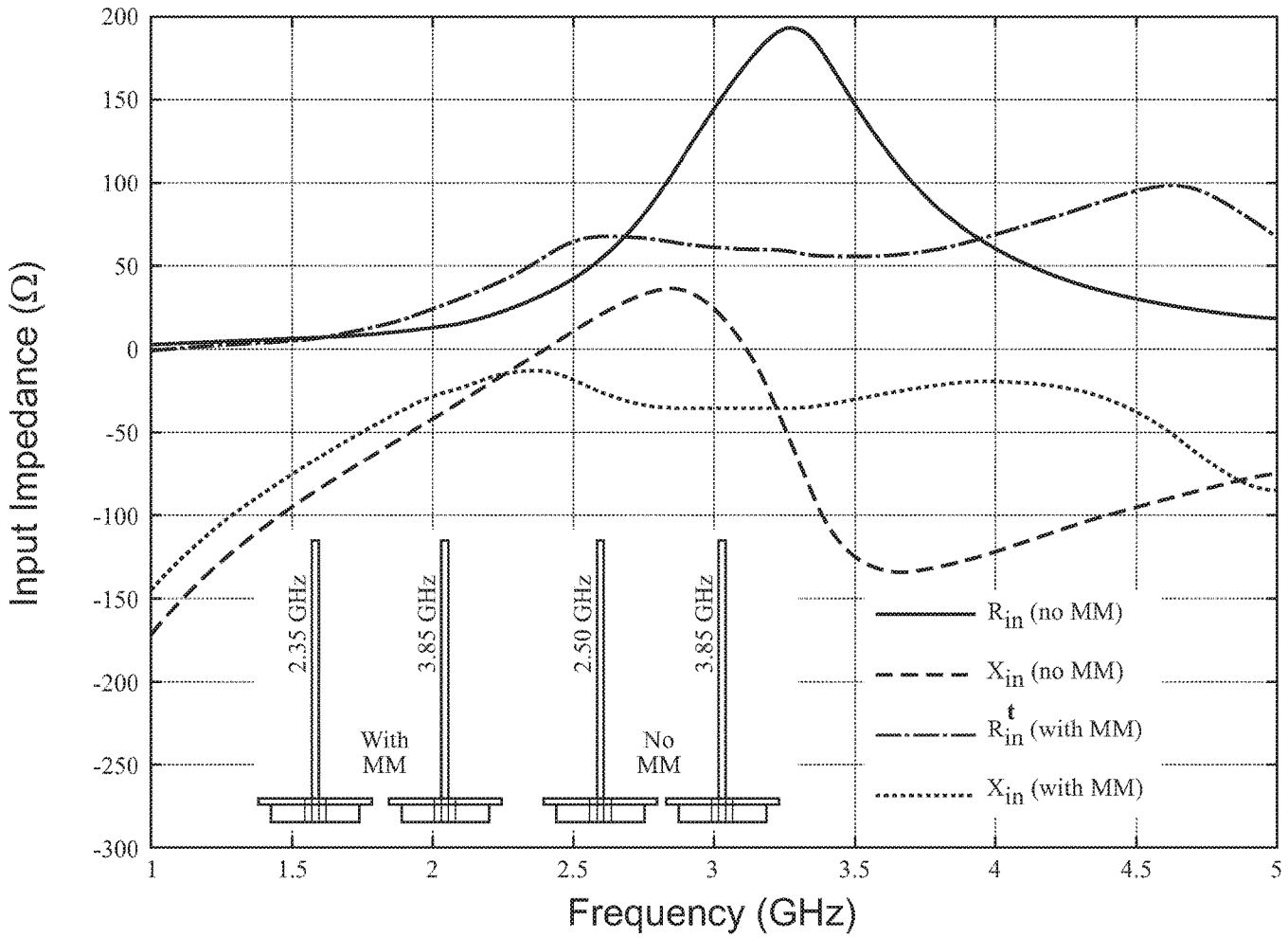
FIG. 5 illustrates simulated input impedance of an exemplary S-band monopole antenna with and without the MM coating where the insets plot the current magnitude distribution on the monopole at various frequencies.

To gain a better understanding of the principle of operation of the anisotropic MM coating, the input impedance of the monopole with and without the coating is provided in FIG. 5, along with the current distributions on the monopole at certain critical frequencies. Without the MM coating, a distinct resonance can be identified around 3.3 GHz with the best matching frequency (for $Z_o$ of 50Ω) at 2.5 GHz. By coating the monopole with the MM, both the real and imaginary parts of the input impedance are flattened in the band of interest, with the real part fairly close to 50Ω and imaginary part varying between −10 to −35Ω. The current plots on the MM coated monopole at 2.35 GHz and 3.85 GHz demonstrate that the fundamental and the MM-introduced resonances have a very similar current distribution that ensures stable in-band radiation patterns. Without the MM, the current at 3.85 GHz has its maxima located nearly $h_a/3$ up from the base of the monopole, resulting in a large reactance for the input impedance. Further examination reveals that the currents on the MM coating are significantly weaker than those on the monopole, indicating that the performance of the coating is expected to be robust with respect to fabrication and assembly tolerances since it is a non-resonant structure.

Figure 6:
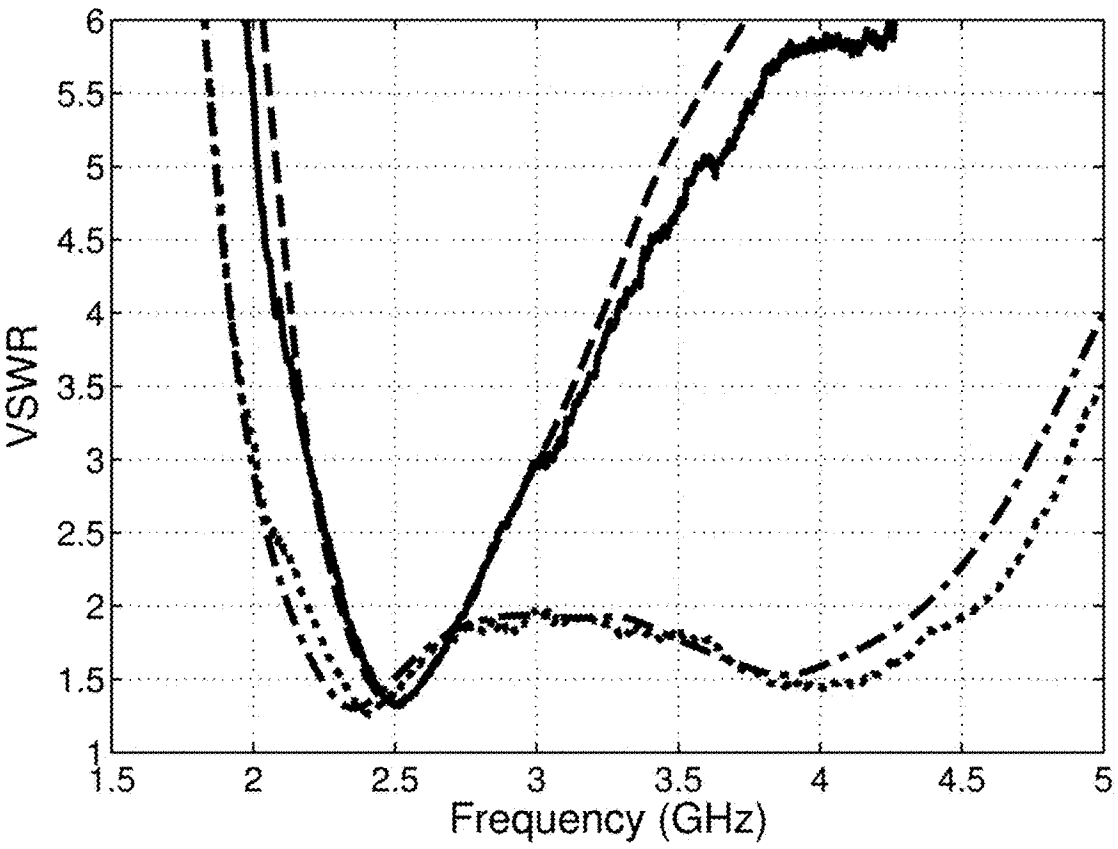
FIG. 6 illustrates simulated and measured VSWR of an S-band monopole antenna with and without an MM coating where the ▬ ▬ is simulated monopole alone, solid line is measured monopole alone, ▬ ▬ is simulated monopole with MM, and ▪ ▪ ▪ ▪ ▪ is measured monopole with MM.
Figure 7A:
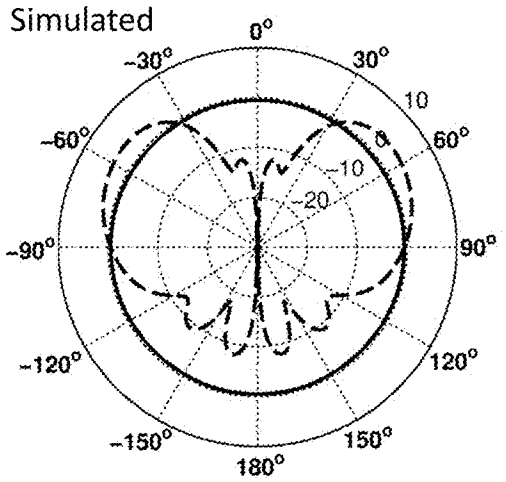
FIG. 7(*a*) illustrates simulated and measured H-plane (x-y plane) and E-plane (y-z plane) radiation patterns of an S-band MM coated monopole at 2.2 GHz with the solid lines representing the H-plane patterns and the dashed lines representing the E-plane patterns.
Figure 7A:
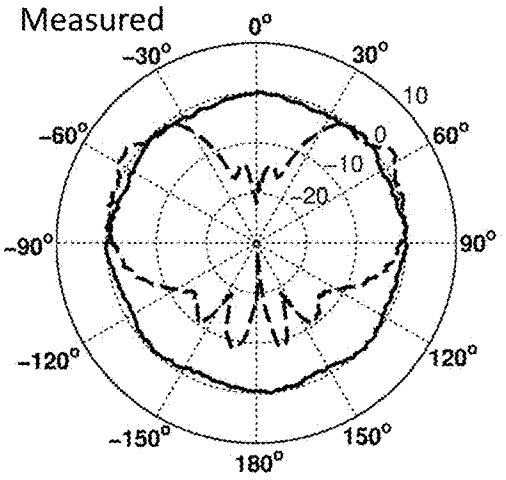
Figure 7B:
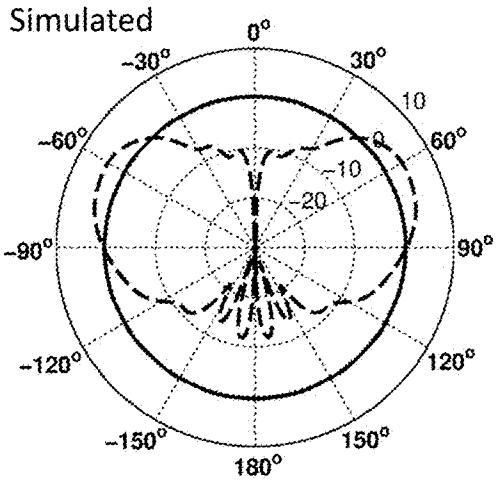
Figure 7B:
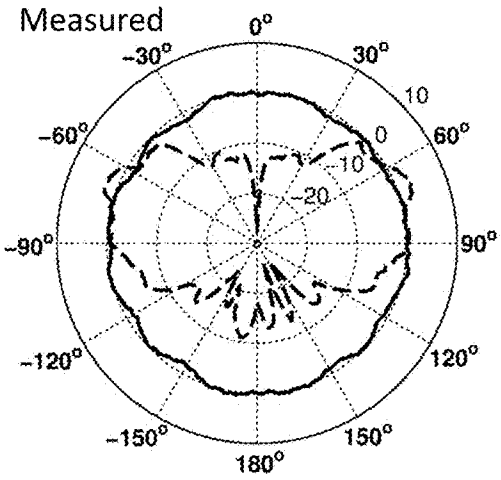
Figure 7C:
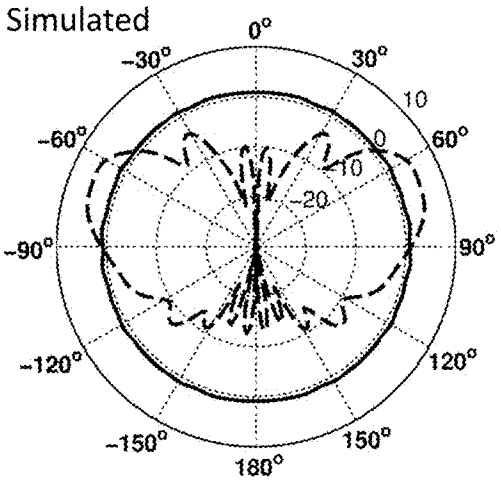
Figure 7C:
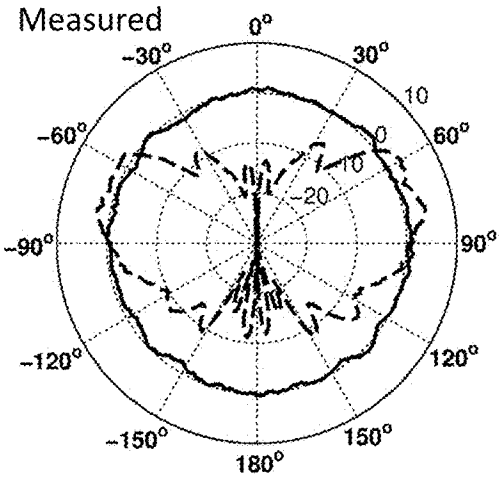

FIG. 6 compares the simulated and measured VSWR curves of the monopole with and without the MM coating on a 32 cm×32 cm ground plane. VSWR measurements were carried out using an Agilent E8364B network analyzer. The measured VSWR of the monopole alone is almost identical to the simulated results with VSWR <2 from 2.3 GHz to 2.7 GHz. With the MM present, a 2.14:1 ratio bandwidth (2.15~4.6 GHz) of VSWR <2 is obtained. Frequency shifts of 0.05 GHz and 0.2 GHz were found in the lower and higher ends of the band, respectively, possibly resulting from a slight tilt between the monopole and the coating, as well as fabrication imperfections.

The radiation patterns of the MM coated monopole were also measured using an anechoic chamber. FIG. 7 presents the simulated and measured E-plane and H-plane patterns at 2.2 GHz, 3.3 GHz, and 4.4 GHz. The H-plane patterns exhibit stable omni-directional radiation characteristics throughout the entire band. The gain variations are around 0.5 dB and 1.2 dB for simulation and measurement, respectively. The increased measured gain variation as a function of the azimuthal angle is primarily caused by the imperfection of assembly and noise, as well as the antenna rotation platform. In the E-plane, characteristic ear-shaped patterns can be observed that are very similar to the patterns for the monopole without the MM, indicating that the added MM coating has negligible impact on the spatial distribution of the radiated energy of the monopole. The maximum gain of the MM coated monopole varies from 3.75 dBi to 5.46 dBi in the VSWR <2 band with the direction of maximum gain moving from 32° to 26° off horizon due to the finite sized ground plane used in both simulation and measurement. The measured gain is 0.3 dB to 0.8 dB smaller than the simulated values. In both simulations and measurements, radiation efficiency above 97% was observed, substantiating the broadband low-loss nature of the MM coating. The overall very good agreement between simulation and measurement confirms the expected performance of the proposed MM antenna coating.

Example 2

Figure 8B:
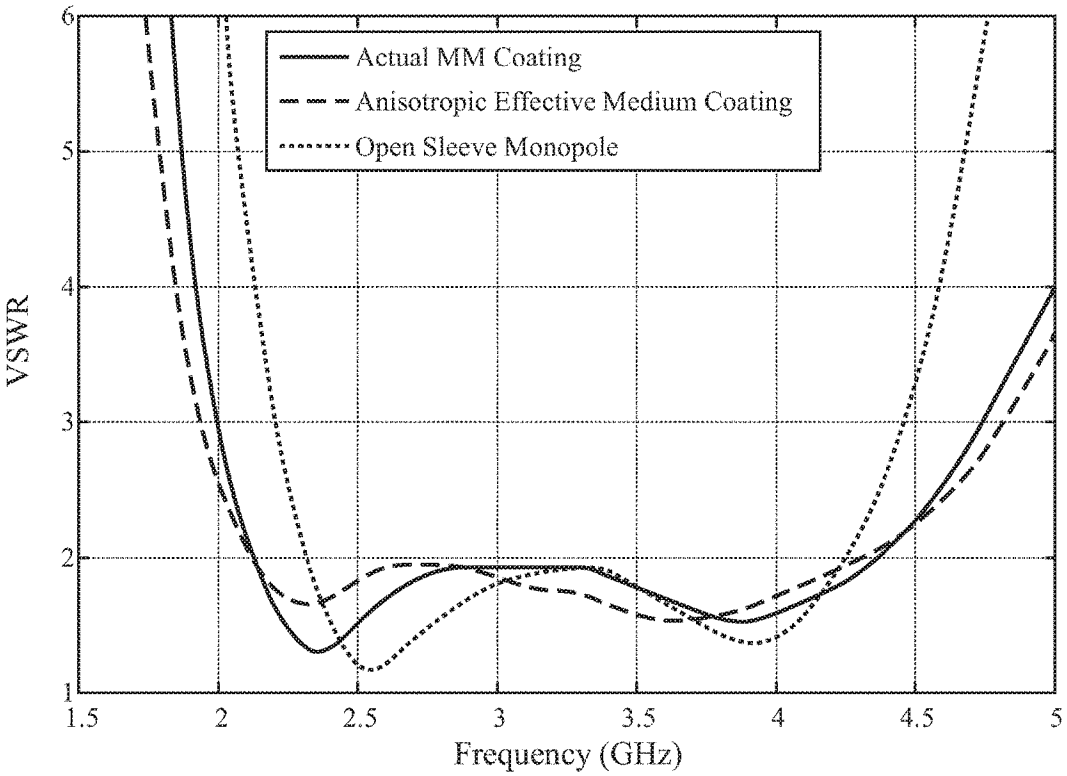
FIG. 8(*a*) illustrates and exemplary monopole antenna surrounded by parasitic conducting sleeves as is known in the art.
Figure 8A:
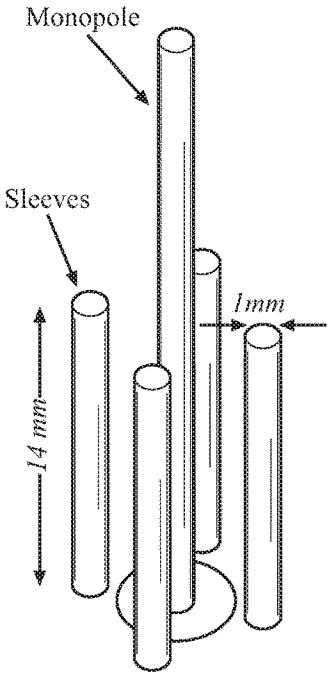
FIG. 8(a) Prior Art

Simulations for monopole antennas surrounded by parasitic conducting sleeves were also performed. When the parasitic conducting sleeves are employed, as shown in FIG. 8(*a*), a monopole-like resonance mode can be excited on the sleeves, thereby extending the impedance bandwidth of the original antenna. The monopole was created with a length of 28.5 mm and the length of each of the sleeves was 14 mm. The radii of both the monopole and the sleeves was 0.5 mm. The distance between the central monopole and the sleeves was 5 mm. As a comparison, the foot print of the open sleeve monopole was maintained identical to that of the metamaterial coated monopole of Example 1 and optimized for the largest possible bandwidth. It can be seen from FIG. 8(*b*) that the sleeve monopole achieves a VSWR <2 bandwidth from 2.3 GHz to 4.15 GHz, which is about 21% narrower than that accomplished using the metamaterial coated monopole of Example 1.

Example 3

The anisotropic metamaterial coating of Example 1 is applied to a broadband quarter-wave monopole antenna for the C-band (4 GHz-8 GHz range). The unit cell of the metamaterial coating is formed of two identical I-shaped copper patterns printed on both sides of a Rogers Ultralam 3850 substrate. The thicknesses of the substrate ($d_s$) and the copper ($d_c$) are 51 μm and 17 μm, respectively. The other dimensions are (all in millimeter): a=2.5, $d_s$=0.051, $d_c$=0.017, w=1.9, b=3.9, c=1.1, g=0.5 and l=2.6. Using this thin flexible substrate, the nominally planar metamaterial structure is formed into a cylindrical configuration.

The monopole is 15 mm long and resonates at 4.5 GHz. The cylindrical metamaterial coating is composed of two concentric layers of metamaterial cells. The inner and outer layers contain eight and sixteen unit cells along their circumference, respectively, in order to approximate a circular outer periphery to minimize its impact on the monopole's omnidirectional radiation patterns in the H-plane. The outer radius of the metamaterial is 3.7 mm or about $\lambda/20$ at 4.5 GHz, ensuring that the ultra-thin subwavelength coating is compact in the radial direction.

Figure 9:
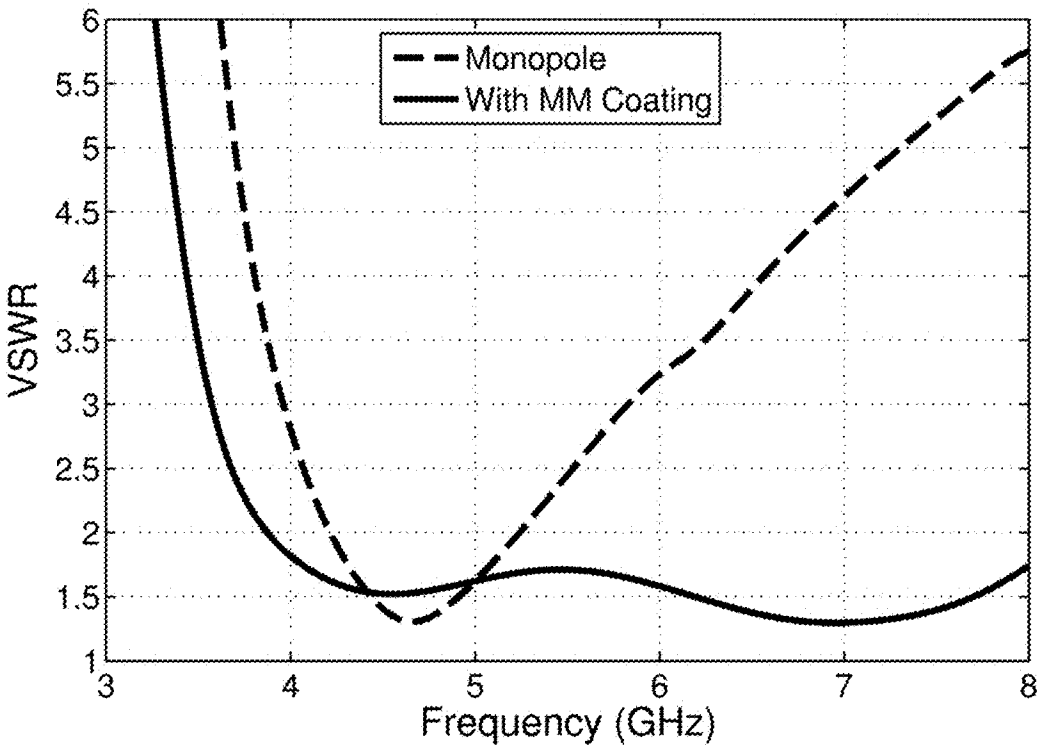
FIG. 9 illustrates simulated VSWR of monopole alone and data from a C-band monopole with an actual metamaterial coating.

To examine the effect of the metamaterial coating on the impedance bandwidth of the monopole, the simulated VSWR for the cases of the monopole alone is compared with the monopole with the metamaterial coating (FIG. 9). The monopole alone yields a VSWR <2 bandwidth of 0.5 GHz (4.5~5.0 GHz) with a single resonance at 4.75 GHz, whereas with the actual metamaterial coating present, the VSWR <2 bandwidth is remarkably broadened to 4.35 GHz (3.85~8.2 GHz). The main resonance shifts down slightly to 4.55 GHz and a new resonance is enabled at 7.0 GHz Overall, a compact (ultra-thin) flexible MM coating was shown to greatly enhance the impedance bandwidth of a quarter-wave wire-type monopole to over an octave. Through the engineered anisotropy of the MM, the coating provides two resonating modes for the antenna with similar current distributions, thus ensuring stable radiation patterns over the entire band. Measurements are shown to be in good agreement with simulated results, confirming the desired performance of the proposed metamaterial-enabled broadband antenna design. This type of flexible MM coating is compact in size, extremely light weight, low in cost, and can be easily scaled to other frequency bands, thereby paving the way for widespread use as radiating elements in, for example, broadband arrays and portable wireless devices.

The invention is not restricted to the illustrative examples described above. Examples described are not intended to limit the scope of the invention. Changes therein, other combinations of elements, and other uses will occur to those skilled in the art.

Various modifications of the present invention, in addition to those shown and described herein, will be apparent to those skilled in the art of the above description. Such modifications are also intended to fall within the scope of the appended claims.

Patents, publications, and applications mentioned in the specification are indicative of the levels of those skilled in the art to which the invention pertains. These patents, publications, and applications are incorporated herein by reference to the same extent as if each individual patent, publication, or application was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

Having described our invention, we claim:

1. An antenna system, comprising:

an antenna, the antenna comprising an elongated conducting segment; and a tubular element of anisotropic metamaterial including a plurality of unit cells, each unit cell comprising a single anisotropic conducting pattern, the conducting pattern defined by an elongated shape so as to produce a maximum permittivity a direction parallel to an elongated direction of the pattern, the anisotropic metamaterial element coating or at least partially surrounding said elongated conducting segment.

2. The antenna system of claim 1, wherein the elongated conducting segment is elongated along an axial direction; and the anisotropic conducting pattern being elongated along a direction parallel to the axial direction.

3. The antenna system of claim 1, the anisotropic metamaterial having a generally cylindrical form having a length, the elongated conducting segment being located within the cylindrical form, said length equal to or greater than an axial length of said elongated conducting segment.

4. The antenna system of claim 1, the anisotropic metamaterial having a dielectric anisotropy.

5. The antenna system of claim 1, the anisotropic metamaterial having a maximum permittivity in a direction parallel to an axial direction of the anisotropic metamaterial.

6. The antenna system of claim 1, the elongated conducting segment being a rod-like conductor.

7. The antenna system of claim 1, the antenna being a monopole antenna.

8. The antenna system of claim 1, said antenna being a monopole antenna.

9. A method of increasing the bandwidth of an antenna, the antenna having an elongated conducting segment having an elongation direction, the method comprising:

disposing an anisotropic metamaterial around the elongated conducting segment, the anisotropic metamaterial having a maximum permittivity in a direction parallel to the elongation direction, the anisotropic metamaterial including a plurality of unit cells, each unit cell comprising a single anisotropic conducting pattern, the conducting pattern defined by an elongated shape so as to produce a maximum permittivity a direction parallel to an elongated a direction of the pattern.

10. The method of claim 9, the anisotropic metamaterial having a cylindrical tube-like form, the cylindrical tube like form having a tube length and an tube inner radius, the antenna having an operating wavelength, the elongated conducting segment having an antenna length and an antenna radius, the tube length being greater than the elongated conducting segment length, the tube inner radius being greater than the elongated conducting segment radius, the tube inner radius being less than the operating wavelength.

11. An anisotropic metamaterial, the anisotropic metamaterial comprising a substrate in a cylindrical tube-like form, an elongation direction, and a plurality of unit cells, each unit cell comprising a single anisotropic conducting pattern, the conducting pattern defined by an elongated shape, the maximum electrical permittivity being greatest along the elongation direction, the anisotropic metamaterial being configured to fit over an antenna.

12. The anisotropic metamaterial of claim 11 associated with a radio transceiver comprising said antenna, said antenna being at least partially enclosed within said anisotropic metamaterial.

13. The anisotropic metamaterial of claim 11 comprising a dielectric substrate and a plurality of conducting elements coated on said substrate.

14. The anisotropic metamaterial of claim 13 wherein said conducting elements are in the shape of an I.

15. The anisotropic metamaterial of claim 13 wherein said conducting elements have a length greater than a width, said length parallel to an axial direction of said cylindrical tube-like form.

16. The anisotropic metamaterial of claim 13 surrounding a conducting segment in a radial direction from said conducting segment.

17. The anisotropic metamaterial of claim 12 having an impedance bandwidth of an octave or greater.

18. The anisotropic metamaterial of claim 13 having a plurality of capacitive gaps between said conducting elements.

19. The anisotropic metamaterial of claim 13 having two or more resonances.

20. The anisotropic metamaterial of claim 13 having a VSWR <2 bandwidth of 1 GHz or greater.

21. The anisotropic metamaterial of claim 20 wherein said bandwidth is 2 GHz or greater.

* * * * *